US005601017A

United States Patent [19]

Schoen

[11] Patent Number: 5,601,017

[45] Date of Patent: Feb. 11, 1997

[54] DEVICE FOR PARALLEL GUIDING OF A RAM OF A HYDRAULIC PRESS

[76] Inventor: Hans Schoen, Lange Horst 87, 45527 Hattingen, Germany

[21] Appl. No.: 562,199

[22] Filed: Nov. 22, 1995

[30] Foreign Application Priority Data

May 4, 1995 [DE] Germany ..... 195 16 359.1

[51] Int. Cl.[6] ..... B30B 1/34; B30B 15/24

[52] U.S. Cl. ..... 100/258 R; 100/269.06; 100/269.17

[58] Field of Search ..... 100/214, 258 R, 100/258 A, 269.06, 269.17, 270, 288

[56] References Cited

U.S. PATENT DOCUMENTS

| | | | |
|---|---|---|---|
| 1,469,689 | 10/1923 | Prius | 100/258 R |
| 1,936,880 | 11/1933 | Rode | 100/214 |
| 2,405,537 | 8/1946 | Werner et al. | 100/258 A |
| 2,670,676 | 3/1954 | Green | 100/258 A |
| 3,118,407 | 1/1964 | Robb | 100/258 R |
| 4,517,879 | 5/1985 | Andersson | 100/258 R |

FOREIGN PATENT DOCUMENTS 2653714 11/1976 Germany .

*Primary Examiner*—Stephen F. Gerrity
*Attorney, Agent, or Firm*—Robert W. Becker & Associates

[57] ABSTRACT

A device for parallel guiding a reciprocating ram of a hydraulic press has a ram of a rectangular contour and a drive unit with hydraulic cylinders for reciprocating the ram. The ram has first and second opposite lateral walls.

10 Claims, 2 Drawing Sheets

DEVICE FOR PARALLEL GUIDING OF A RAM OF A HYDRAULIC PRESS

BACKGROUND OF THE INVENTION

The present invention relates to a device for parallel guiding the ram of a hydraulic press, for example, of a stamping press. For the reciprocation of the ram a drive with hydraulic cylinders is provided. The contour of the ram is substantially rectangular.

In the hydraulic presses which are known in various embodiments in the prior art the reciprocating movement of the press ram is effected with a single pressure medium cylinder or with a plurality of parallel-operating pressure medium cylinders. In all cases the parallel guiding of the stamping ram during the working movement is important. Reasons for the deviation of the parallel guiding action can be asymmetric loading and/or deviations within the operation of the parallel acting pressure medium cylinders.

When for driving the pressing ram two or more pressure medium cylinders are provided, measures must be taken which ensure an absolutely simultaneous operation of the pressure medium cylinders so that canting is prevented. Known devices for ensuring simultaneous operation for providing parallel guiding of the press ram are in general operated with a hydraulic-electronic control. Such devices are complicated and cost-intensive. Furthermore, they operate with delay because they can only be activated after at least the tendency for a beginning canting of the press ram has been detected.

The aforementioned problems are the main reason that even with hydraulic presses for relatively high working pressures it has been preferred to use a single pressure medium cylinder for driving the press ram in a fine-cutting press with high cutting precision requirements. For example, such a single pressure medium cylinder is arranged below the reciprocating press ram. In presses with very high working pressures of, for example, 10,000 kN the relatively large pressure medium cylinder must be secured in a foundation provided in a correspondingly large recess. This requires additional constructive measures during installation of such a hydraulic fine-cutting press which incur considerable expenditures.

It is therefore an object of the present invention to provide a device for parallel guiding of the press ram of a hydraulic press having simple reliable mechanical means for ensuring a reliable parallel guiding of the press ram without delay.

SUMMARY OF THE INVENTION

A device for parallel guiding a reciprocating press ram of a hydraulic press according to the present invention is primarily characterized by:

A press ram of a rectangular contour;

A drive unit comprising hydraulic cylinders for reciprocating the press ram;

The press ram having a first and a second oppositely arranged lateral walls;

A first gear set comprised of:

a) at least two first inner shafts rotatably connected to the press ram so as to extend from the first lateral wall to the second lateral wall such that free ends of the first inner shafts project from the lateral walls;

b) first meshing inner gear wheels, wherein at least two of the first meshing inner gear wheels are fixedly connected to the free ends of the first inner shafts at the first lateral wall and at least two of the first meshing inner gear wheels are fixedly connected to the free ends of the first inner shafts at the second lateral wall, the first inner gear wheels being of identical size;

c) the at least two first inner shafts positioned in a first common horizontal plane;

d) two first outer shafts rotatably connected to the press ram so as to extend from the first lateral wall to the second lateral wall such that free ends of the first outer shafts project from the lateral walls;

e) the first outer shafts positioned in the first common horizontal plane opposite one another relative to the at least two first inner shafts;

f) a first outer gear wheel fixedly connected to each one of the free ends of the outer shafts, wherein the first outer gear wheels mesh with an adjacent one of the first inner gear wheels; and g) all of the first outer gear wheels having identical size; and four toothed racks positioned parallel to a direction of travel of the press ram, wherein each one of the first outer gear wheels meshes with one of the toothed racks.

In a preferred embodiment of the present invention the device further comprises a second gear set comprised of:

a) at least two second inner shafts rotatably connected to the ram so as to extend from the first lateral wall to the second lateral wall such that free ends of the second inner shafts project from the lateral walls;

b) second meshing inner gear wheels, wherein at least two of the second meshing inner gear wheels are fixedly connected to the free ends of the second inner shafts at the first lateral wall and at least two of the second meshing inner gear wheels are fixedly connected to the free ends of the second inner shafts at the second lateral wall, the second inner gear wheels being of identical size;

c) the at least two second inner shafts positioned in a second common horizontal plane;

d) two second outer shafts rotatably connected to the press ram so as to extend from the first lateral wall to the second lateral wall such that free ends of the second outer shafts project from the lateral walls;

e) the second outer shafts positioned in the second common horizontal plane opposite one another relative to the at least two second inner shafts;

f) a second outer gear wheel fixedly connected to each one of the free ends of the second outer shafts, wherein the second outer gear wheels mesh with an adjacent one of the second inner gear wheels; and g) all of the second outer gear wheels have an identical size; and each one of the second outer gear wheels meshes with one of the toothed racks.

Advantageously, the second outer gear wheels have a smaller diameter than the second inner gear wheels.

Preferably, the device further comprises bearings in which the second inner shafts and the second outer shafts are supported without play.

In a preferred embodiment of the present invention the device further comprises two parallel auxiliary shafts extending in a plane parallel to the first common horizontal plane, the auxiliary shafts rotatably connected to the ram so as to extend from the first lateral wall to the second lateral wall such that free ends of the auxiliary shafts project from the lateral walls. Four auxiliary gear wheels, each one connected to one of the free ends of the auxiliary shafts, are provided. Each one of the auxiliary gear wheels meshes with one of the toothed racks.

Advantageously, the device further comprises bearings in which the auxiliary shafts are supported without play.

Preferably, the first and the second lateral walls of the press ram are the narrow sides of the rectangular contour.

Advantageously, the first outer gear wheels have a smaller diameter than the first inner gear wheels.

Expediently, the device further comprises bearings in which the first inner shafts and the first outer shafts are supported without play.

In yet another embodiment of the present invention, the first and the second lateral walls of the press ram have glide surfaces for guiding the press ram along cooperating glide surfaces at the hydraulic press during reciprocation.

The device of the present invention is basically comprised of a gear mechanism, comprised of gear wheels and a toothed rack which forces the press ram to move parallel to the press table and to operate without delay. Canting of the press ram due to asymmetrical workpiece loading and/or non-uniform working pressure medium cylinders can no longer occur.

For improving the parallel guiding and for reducing the specific loading of the gear components, it is expedient to provide at the press ram in a second parallel horizontal plane a second gear set that is identical to the first gear set comprised of gear wheels and shafts. It is furthermore possible to provide in a third horizontal plane two further parallel auxiliary shafts which at their free ends are provided with gear wheels which also engage the toothed racks.

For spatial reasons it may be expedient to provide meshing gear wheels of different size. It is advantageous to use for the paired (first and second) meshing inner gear wheels a greater diameter than for the (first and second) outer gear wheels. The bearings for all shafts are embodied such that they ensure a play-free support.

In order to secure the press ram also against possible displacement parallel to the axis of rotation of the shafts, it is expedient to provide the press ram with glide surfaces at its end faces (lateral walls) carrying the gear wheels. These glide surfaces cooperate with corresponding glide surfaces at the frame of the hydraulic press during the reciprocating movement of the press ram.

With the inventive design it is thus possible, for example, for a fine-cutting press, to use, instead of a single hydraulic cylinder for operating the press ram, four smaller hydraulic cylinders which can be mounted without problem at the upper portion of the hydraulic press. This results in the further advantage that no foundation in a dugout recess is required and that the hydraulic press must not be demounted for transport.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
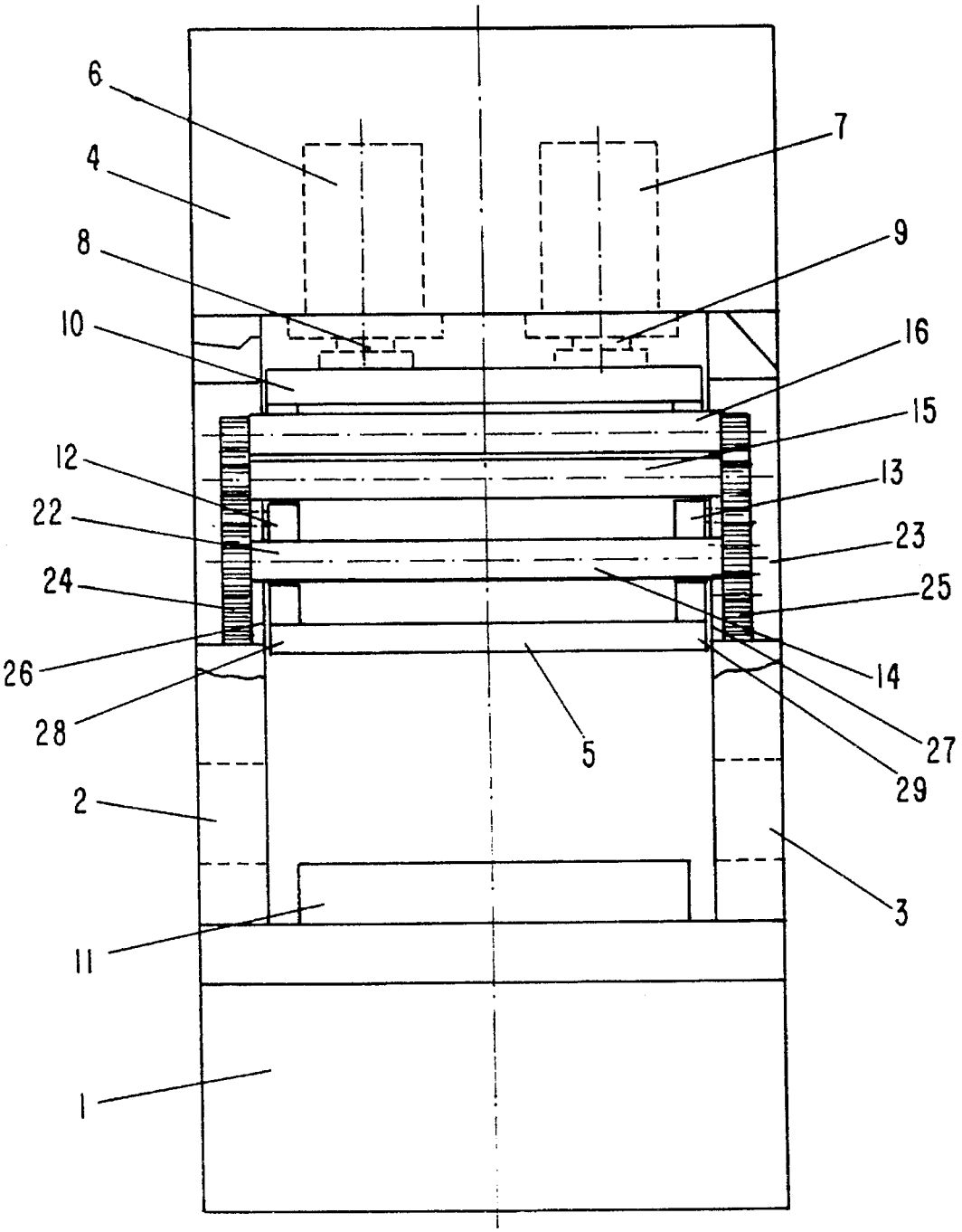
FIG. 1 shows an end view of a hydraulic press with inventive device for parallel guiding the press ram, partly in section in the plane I—I of FIG. 2 shows a side view of the inventive hydraulic press.
Figure 2:
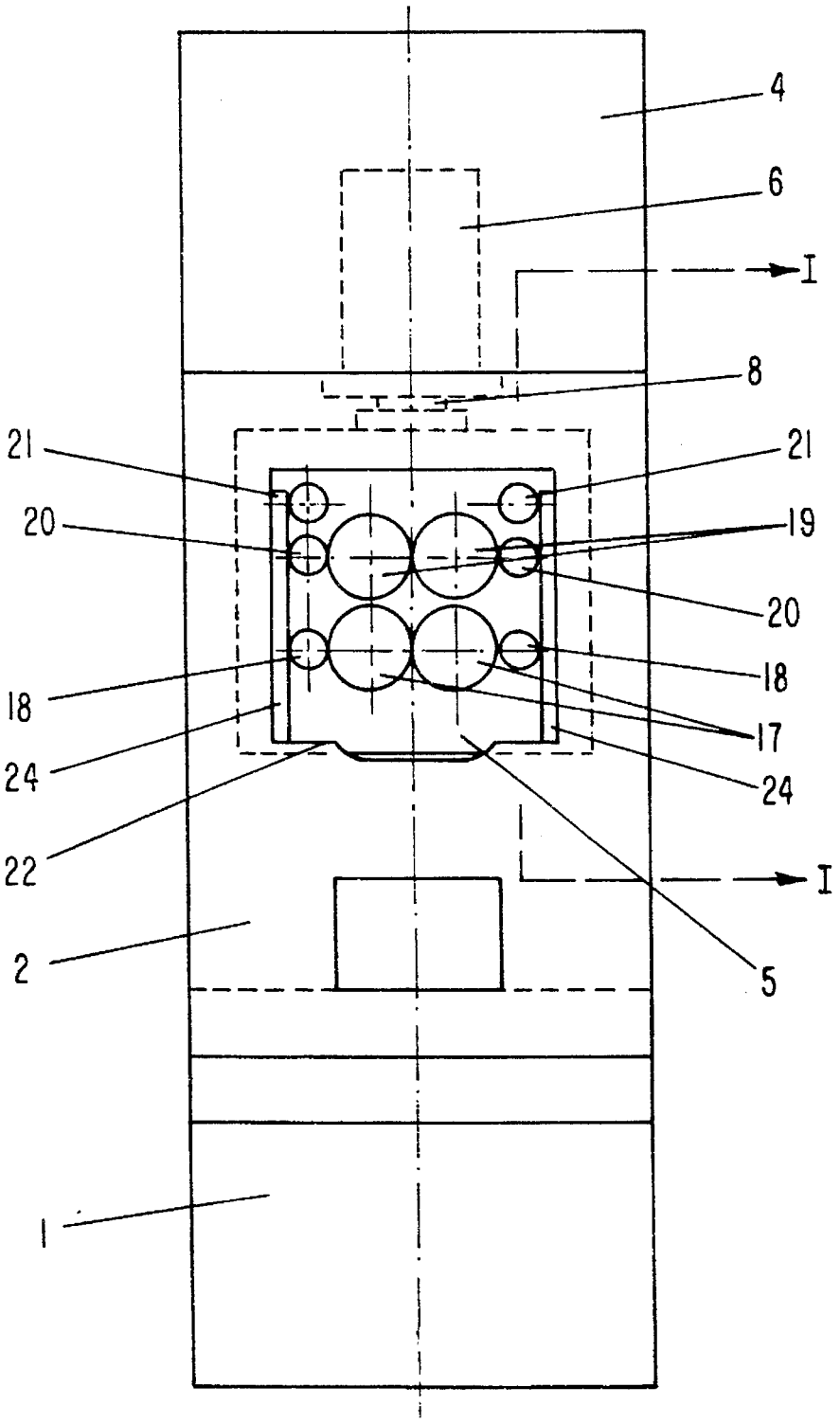

The present invention will now be described in detail with the aid of a specific embodiment utilizing FIGS. 1 and 2.

The shown hydraulic press is comprised substantially of a lower portion 1, two side portions 2, 3 and an upper portion 4. The lower portion 1 and the upper portion 4 are connected to one another via the lateral portions 2, 3 by non-represented tie rods.

The press ram (stamp, die, punch, plunger etc.) can be reciprocated between the lateral portions 2, 3 with the aid of pressure medium cylinders 6, 7 arranged at the upper portion 4 and operating in parallel.

The piston rods 8, 9 of the pressure medium cylinders 6, 7 engage the upper cover 10 of the box-shaped press ram 5 and effect a working stroke and a return stroke. The machining tool is to be connected to the underside of the press ram 5 in an exchangeable manner. The counter tool is arranged on the table 11 which rests on the lower portion 1.

The thus disclosed construction of a hydraulic press is known in general. It is necessary to guide the press ram 5 over the entire stroke absolutely parallel to the table 11 whereby this parallel guiding should not be affected by non-central loading within the pressure-application range and/or due to non-uniformness within the operation of the parallel-acting pressure medium cylinders 6, 7. This is ensured with the inventive device for parallel-guiding the press ram 5 disclosed in the following.

In the shown embodiment, the box-shaped press ram 5 has parallel sidewalls 12, 13 which are preferably the narrow sides of the box-shaped press ram 5. A total of 10 shafts is positioned in three horizontal parallel planes without play in bearings within the press ram 5 so as to be axially non-slidable. Their free ends project outwardly through cutouts in the sidewalls 12, 13. In a lower (first) horizontal plane and a (second) central horizontal plane four shafts each are arranged. In the upper horizontal plane two shafts are positioned. All shafts project laterally from the press ram 5 and have gear wheels fixedly connected to their projecting free ends. The shafts positioned within the respective parallel horizontal planes are indicated with reference numerals 14, 15, and 16.

Within the (first) lower horizontal plane a first gear set is provided. Its gear wheels are designed such that on each lateral wall of the press ram 5 all four gear wheels connected to the shafts 14 mesh with one another. The gear wheels on the opposite (second) lateral wall of the press ram 5 are of the same size as the gear wheels on the first lateral wall. In the shown embodiment the first inner gear wheel 17 have a greater diameter than the first outer gear wheels 18.

In the second horizontal plane thereabove, in which the shafts 15 are positioned, a second gear set is provided. Its gear wheels 19, 20 (second gear wheels) have the same size as the first gear wheels 17, 18 of first gear set of the lower (first) horizontal plane. In the upper horizontal plane, in which the shafts 16 extend, only outer gear wheels 21 are provided which have the same size as the gear wheels 18, 20.

In the side portions 2, 3 of the press frame rectangular windows 22, 23 are provided which provide free space for positioning the gear wheels at the press ram 5 during the entire working and reciprocating stroke. Each window 22, 23 has lateral limiting walls to which are connected toothed racks 24, 25. Each is positioned parallel to the direction of movement of the press ram such that the corresponding outer gear wheels 18, 20, 21 mesh with the respective neighboring toothed rack 24, 25.

The gear systems mechanism comprised of the described gear sets causes during the working and reciprocating stroke of the press ram 5 a forced parallel movement of the press ram 5. Since in the two lower (first and second) horizontal planes the respective four shafts 14, 15 of each plane are in gear connection with one another, the first and second outer gear wheels 18, 20 which mesh with the toothed racks 24, 25 can perform only a synchronous movement. Due to this forced parallel guiding, canting of the press ram 5 is reliably prevented.

In order to also prevent transverse movement of the press ram 5, i.e., movements parallel to the axis of rotation of the shafts 14 to 16, the narrow sides of the press ram 5 are provided with additional glide surfaces. For this purpose, the side portions 2, 3 are provided along the travel path with glide surfaces 26, 27 at which the press ram 5 is guided during the reciprocating movement with corresponding glide surfaces 28, 29.

In the shown embodiment gear wheels and shafts are arranged in three stacked horizontal planes at the press ram 5. It should be noted that the press ram 5 can be forcibly guided in parallel to the table with only one gear set in one horizontal plane when it is of the same design as the first and second gear sets of the first and second horizontal planes. Such an arrangement can be used for hydraulic presses of smaller output. For hydraulic presses to be used with especially high workloads or for great cutting precision, however, it is advantageous that gear sets in two or three parallel planes are provided in order to limit especially the specific loading of the gear components.

The present invention is, of course, in no way restricted to the specific disclosure of the specification and drawings, but also encompasses any modifications within the scope of the appended claims.

What I claim is:

1. A device for parallel guiding of a reciprocating press ram of a hydraulic press, said device comprising:

a press ram of a rectangular contour;

a drive unit comprising hydraulic cylinders for reciprocating said press ram;

said press ram having a first and a second oppositely arranged lateral walls;

a first gear set comprised of:

a) at least two first inner shafts rotatably connected to said press ram so as to extend from said first lateral wall to said second lateral wall such that free ends of said first inner shafts project from said lateral walls;

b) first meshing inner gear wheels, wherein at least two of said first meshing inner gear wheels are fixedly connected to said free ends of said first inner shafts at said first lateral wall and at least two of said first meshing inner gear wheels are fixedly connected to said free ends of said first inner shafts at said second lateral wall, said first inner gear wheels being of identical size;

c) said at least two first inner shafts positioned in a first common horizontal plane;

d) two first outer shafts rotatably connected to said press ram so as to extend from said first lateral wall to said second lateral wall such that free ends of said first outer shafts project from said lateral walls;

e) said first outer shafts positioned in said first common horizontal plane opposite one another relative to said at least two first inner shafts;

f) a first outer gear wheel fixedly connected to each one of said free ends of said first outer shafts, wherein said first outer gear wheels mesh with an adjacent one of said first inner gear wheels; and g) all of said first outer gear wheels having identical size; and four toothed racks positioned parallel to a direction of travel of said press ram, wherein each one of said first outer gear wheels meshes with one of said toothed racks.

2. A device according to claim 1, further comprising a second gear set comprised of:

a) at least two second inner shafts rotatably connected to said press ram so as to extend from said first lateral wall to said second lateral wall such that free ends of said second inner shafts project from said lateral walls;

b) second meshing inner gear wheels, wherein at least two of said second meshing inner gear wheels are fixedly connected to said free ends of said second inner shafts at said first lateral wall and at least two of said second meshing inner gear wheels are fixedly connected to said free ends of said second inner shafts at said second lateral wall, said second inner gear wheels being of identical size;

c) said at least two second inner shafts positioned in a second common horizontal plane;

d) two second outer shafts rotatably connected to said press ram so as to extend from said first lateral wall to said second lateral wall such that free ends of said second outer shafts project from said lateral walls;

e) said second outer shafts positioned in said second common horizontal plane opposite one another relative to said at least two second inner shafts;

f) a second outer gear wheel fixedly connected to each one of said free ends of said first outer shafts, wherein said second outer gear wheels mesh with an adjacent one of said second inner gear wheels; and g) all of said second outer gear wheels having an identical size; and wherein each one of said second outer gear wheels meshes with one of said toothed racks.

3. A device according to claim 2, wherein said second outer gear wheels have a smaller diameter than said second inner gear wheels.

4. A device according to claim 2, further comprising bearings in which said second inner shafts and said second outer shafts are supported without play.

5. A device according to claim 1, further comprising:

two parallel auxiliary shafts extending in a plane parallel to said first common horizontal plane, said auxiliary shafts rotatably connected to said press ram so as to extend from said first lateral wall to said second lateral wall such that free ends of said auxiliary shafts project from said lateral walls;

four auxiliary gear wheels, each one connected to one of said free ends of said auxiliary shafts; and wherein each one of said auxiliary gear wheels meshes with one of said toothed racks.

6. A device according to claim 5, further comprising bearings in which said auxiliary shafts are supported without play.

7. A device according to claim 1, wherein said first and said second lateral walls of said press ram are the narrow sides of the rectangular contour.

8. A device according to claim 1, wherein said first outer gear wheels have a smaller diameter than said first inner gear wheels.

9. A device according to claim 1, further comprising bearings in which said first inner shafts and said first outer shafts are supported without play.

10. A device according to claim 1, wherein said first and said second lateral walls of said press ram have glide surfaces for guiding said press ram along cooperating glide surfaces on the hydraulic press during reciprocation.

* * * * *